US005294850A

United States Patent [19]

Weh et al.

[11] Patent Number: 5,294,850

[45] Date of Patent: Mar. 15, 1994

[54] ELECTROMAGNETIC ACCELERATOR IN FLAT COIL ARRANGEMENT

[75] Inventors: Herbert Weh; Hardo May, both of Braunschweig; Markus Löffler, Unterlüss, all of Fed. Rep. of Germany

[73] Assignee: Rheinmetall GmbH, Düsseldorf, Fed. Rep. of Germany

[21] Appl. No.: 945,917

[22] Filed: Sep. 17, 1992

[30] Foreign Application Priority Data

Sep. 23, 1991 [DE] Fed. Rep. of Germany ..... 4131595

[51] Int. Cl.[5] ..... F41F 7/00; F41B 6/00

[52] U.S. Cl. ..... 310/13; 89/8; 124/3

[58] Field of Search ..... 310/12, 13; 124/3; 89/8; 104/292

[56] References Cited

U.S. PATENT DOCUMENTS 1,370,200 3/1921 Fauchen-Villepleé ..... 124/3
4,577,545 3/1986 Kemeny ..... 89/8
4,796,511 1/1989 Eyssa ..... 89/8
4,817,494 4/1989 Cowan ..... 89/8
4,858,511 8/1989 Jasper, Jr. ..... 89/8

*Primary Examiner*—R. Skudy
*Assistant Examiner*—Judson H. Jones
*Attorney, Agent, or Firm*—Spencer, Frank & Schneider

[57] ABSTRACT

An electromagnetic accelerator arrangement includes a stationary arrangement including at least one stationary primary coil, and a movable arrangement including at least one moveable secondary coil. The planes of the stationary and the moveable coils are parallel to a direction of movement of the moveable arrangement. The coils of the stationary and the movable arrangements have approximately the same coil width in the direction of movement of the moveable arrangement and transversely thereto, as well as the same coil separation in the direction of movement of the moveable arrangement. The at least one stationary primary coil includes at least two layers between which the at least one secondary coil of the movable component is movably disposed, the distance between the layers being kept small transversely to the direction of movement of the moveable arrangement.

12 Claims, 4 Drawing Sheets

ELECTROMAGNETIC ACCELERATOR IN FLAT COIL ARRANGEMENT

CROSS-REFERENCE TO RELATED APPLICATION

This application claims the priority of Application Ser. No. DE P 41 31 595.2, filed on Sep. 23rd, 1991 in the Federal Republic of Germany, the subject matter of which is incorporated herein by reference.

BACKGROUND OF THE INVENTION

1. Field of The Invention

The invention relates to the field of electromagnetic accelerators, in particular to electromagnetic catapults.

2. Background Information

The acceleration of flying bodies or projectiles with the aid of electromagnetic catapults has known advantages over conventional driving methods operating on the basis of internal combustion engines or by using explosion pressure. Electromagnetic accelerators can be technologically grouped with linear drives or motors, but are characterized by very short periods of operation. Compared to the conventional design of linear motors, for example as used in automobile transportation, in electromagnetic accelerators, extraordinarily high force densities are realized if the loads occur only very briefly.

A basic electromagnetic accelerator includes a primary coil arrangement for a stationary portion and a moving translator equipped with one or a plurality of secondary coils. The respective motion state, i.e., position and velocity, of the translator must be taken into account in determining the energy requirements of the coils for operation. The necessary electrical power depends on the mechanics of the acceleration process, that is, on mass, final velocity and acceleration path. However, it is also very much determined by the efficiency of the conversion of electrical energy into mechanical energy. The latter is a function of the intensity of the interaction between the magnetic field and the electrical currents. The field-current interaction is also closely interrelated with the forces acting on the coils. Since a relatively inefficient field-current interaction requires the use of increased electrical currents to obtain the required accelerating force, this also creates power loss problems and consequently higher thermal effects. The realizability of very high performance transducers therefore depends greatly on the intensity and efficiency of the current-field interaction.

In the topology of conventional coaxial, cylindrical coil electromagnetic accelerator, in which stator coils and translator coils form a circularly cylindrical arrangement, conditions are rather unfavorable and result in inefficient electromechanical energy conversion, as well as high mechanical and thermal stresses on the coils.

SUMMARY OF THE INVENTION

It is thus an object of the invention to improve over the above-described conventional coaxial accelerator configuration and to provide an improved field-current interaction which permits, with minimal mechanical and thermal stresses on the coil, maximum thrust yield, thereby providing a more favorable ratio of electrical power to mechanical power.

This is accomplished according to one embodiment of the invention wherein an electromagnetic accelerator arrangement comprises a stationary arrangement including at least one stationary primary coil and a movable arrangement including at least one movable secondary coil wherein the planes of the coils are parallel to a direction of movement of the movable arrangement, the coils of the stationary and the movable arrangements have approximately the same coil width in the direction of movement of the movable arrangement and transversely thereto, as well as the same coil separation in the direction of movement of the movable arrangement, and wherein the at least one stationary primary coil comprises at least two layers between which the at least one secondary coil of the movable component is movably disposed, the distance between the layers being kept small transversely to the direction of movement of the movable arrangement.

According to a further embodiment of the invention, the movable arrangement comprises a flying instrument and the stationary coil layers comprise correspondingly shaped primary coils disposed external to the flying instrument and electrically connected with one another such that a small distance is realized therebetween.

In another embodiment, surfaces of the primary coils are bent or curved. According to another embodiment, the primary coil is divided into more than two layers and the secondary coil into more than one layer, with a small distance being maintained between respective layers. In yet another embodiment, the movable coil arrangement is pre-excited when the movable arrangement is at a standstill. In another embodiment, the stationary primary coil is constructed as a multi-conductor coil arrangement. And in yet another embodiment, a plurality of primary coils are provided for the stationary arrangement, the number of windings per primary coil of the stationary arrangement decreasing in the direction of movement of the movable arrangement along the stationary arrangement.

BRIEF DESCRIPTION OF THE DRAWINGS

The invention will be described in the detailed description with reference to the drawing figures, in which.

DETAILED DESCRIPTION OF THE PREFERRED EMBODIMENTS

The invention will now be described in more detail by example with reference to the embodiments shown in the Figures. It should be kept in mind that the following described embodiments are only presented by way of example and should not be construed as limiting the inventive concept to any particular physical configuration.

As already mentioned, the coil topology of an accelerator arrangement has a great influence on the efficiency of electrical to mechanical energy conversion. The ratio of electrical energy to mechanical energy, where mechanical energy is determined by $\frac{1}{2}$ $mv^2$ (where m is the translator mass and v the final velocity), can be kept small by a favorable arrangement of stator and translator coils. The ideal case is where the electrical energy supplied does not exceed the value of the mechanical energy. The significant advantages of a flat coil arrangement according to the present invention compared to a conventional coaxial coil configuration can be explained by considering the model arrangements shown in FIGS. 1 and 2.

Figure 1:
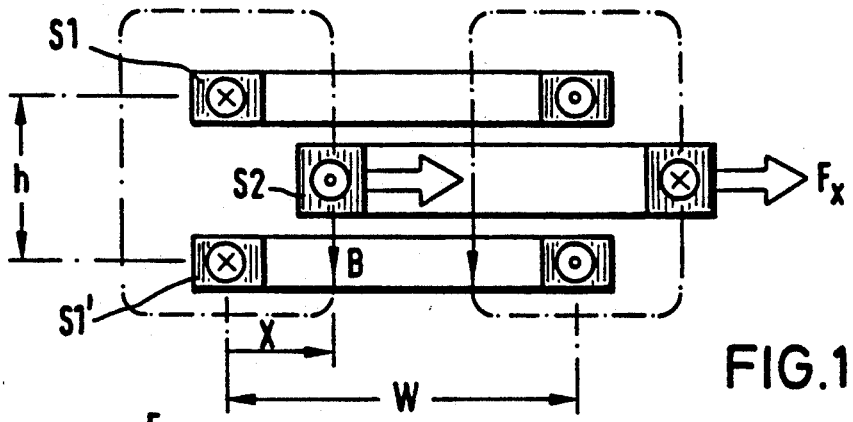
FIG. 1 shows the basic model of a flat coil accelerator arrangement composed of stationary primary coils S1 and S1' disposed above and below, respectively, the movable secondary coil S2 to be accelerated.

FIG. 1 is a sectional view of a flat coil arrangement. The field lines generated by the primary current in coils S1 and S1' are shown schematically. At the location of coil S2, the translator coil, the field lines correspond to a vertically downwardly oriented magnetic induction of a magnitude B. It is a characteristic of the symmetrical arrangement of the stator coil in two layers, e.g., S1 and S1', and assuming identical currents, that translator coil S2 has no magnetic induction component in the x direction. The field-current interaction in translator coil S2 which leads to the generation of acceleration force $F_x$ is determined by the full magnetic induction of magnitude B of the primary coil arrangement at the location of the secondary, i.e., translator coil. Thus, with a given field, a maximum value is realized for the accelerating driving force $F_x$. The direction of the developing force of the translator coil is therefore oriented exclusively in the direction of movement (x). The driving force components each act uniformly on one side of the secondary coil and the primary coils are subjected to oppositely acting forces. If, as a result of the force, the translator coil moves to the right, changes in force occur proportionally to changes in primary induction B and changes in current in the secondary coil. The change of B depends on the geometry of the arrangement, i.e., the ratio of h/w, with a gradual decrease in B approaching the middle of the primary coil arrangement existing for practically relevant conditions. It is advisable to provide a primary coil arrangement, e.g., a multi-conductor arrangement, which maintains the interaction as continuously as possible (not shown in the model of FIG. 1).

FIG. 1 further shows that the greatest field densities occur within the primary coil arrangement wherever the secondary coil is disposed. In the exterior region, i.e., external to the primary coil arrangement, the field is widened and thus B is reduced.

Figure 2:
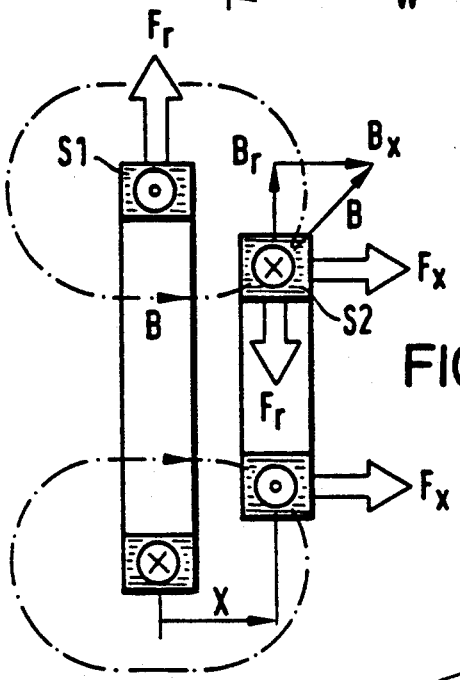
FIG. 2 shows for comparison a model of a conventional coaxial coil arrangement composed of a stationary primary coil S1 and a movable secondary coil S2.

As can be seen in the illustration of FIG. 2, distinct differences result for the conventional coaxial coil arrangement. The translator coil S2 is disposed in a primary field B which has a radial component $B_r$ as well as an axial component $B_x$. The propelling force $F_x$, however, is generated only by the radial component of B. The axial component $B_x$, in interaction with the secondary current, generates an inwardly oriented radial force $F_r$ which stresses the secondary coil S2 with pressure. Conversely, the outwardly acting radial force $F_r$ creates a tensile stress on the primary coil S1. Compared to the arrangement of FIG. 1, the conventional coaxial transducer requires additional measures, i.e., reinforcement against tensile stresses, to absorb the radial coil forces.

As can be derived from a comparison of the various arrangements and as confirmed by mathematical examinations, in the conventional coaxial arrangement of FIG. 2, much higher currents are required to generate defined propelling forces. The main reason for this is the described less efficient field-current interaction, but also, in the coaxial arrangement, the generation of the magnetic field is in principle impeded by a greater magnetic resistance. In the interior of primary coil S1, the essentially axial orientation of the field and its associated magnetic resistance, which reduces propelling efficiency, are determined primarily by the axial component $B_x$. In the coaxial arrangement, the generation of the magnetic field requires higher currents for this reason as well.

High primary currents and an increased flux through the primary coil under otherwise similar conditions also requires the use of a higher voltage and, because of the increased product of voltage times current, leads to increased power requirements. As a result of the unfavorable coaxial topology, increased thermal stresses result in addition, caused by higher currents and current densities, respectively, as well as the already mentioned parasitic force effects on the primary and secondary coils, which must be dealt with by reinforcing measures to increase component strength. However, coils that are reinforced with fiber inserts, for example, exhibit unfavorable thermal characteristics.

The inductive method is primarily applicable for the generation of a secondary current. Also with a view toward its use, it is important for coils S1 and S2 to be arranged in such a manner that they are well coupled. The embodiment of a coil arrangement in which S2 is enclosed by two symmetrical primary windings S1 and S1', e.g., as in the FIG. 1 embodiment, and where there are only small spaces between the layers, produces optimum conditions in this respect. Due to the lack of symmetry in FIG. 2, conditions are noticeably more unfavorable. The arrangement according to FIG. 2 also shows that the decrease in force with larger coil spacings in the x direction is greater than in the case of FIG. 1.

In connection with FIG. 1 as well as FIG. 2, it should be mentioned that the coil arrangement generally involves a larger number of coils which are activated by the translator in dependence on the x position. In order to realize great driving forces over a longer path, the primary coil system also receives power as a function of velocity. If, for example, it is necessary to have the same driving force at the end of the acceleration path as at its beginning, this means that, with approximately identical coil currents and the same number of windings in each of the primary coils, a voltage is required that increases in proportion with the velocity. By reducing the number of windings toward the transducer output, i.e., the end of the acceleration path, the required voltage can be made more uniform. In order to avoid a sudden drop in force, it is further advisable to select a coil arrangement in which, analogous to multi-phase windings, the magnetic field is carried along with the translator in a uniform size.

To increase the interaction between the field and the secondary current, measures are also employed which excite the secondary component when it is still at a standstill. With such a pre-excitation, it is possible to realize a greater force yield in the course of the acceleration process for a given electrical power.

Figure 3A:
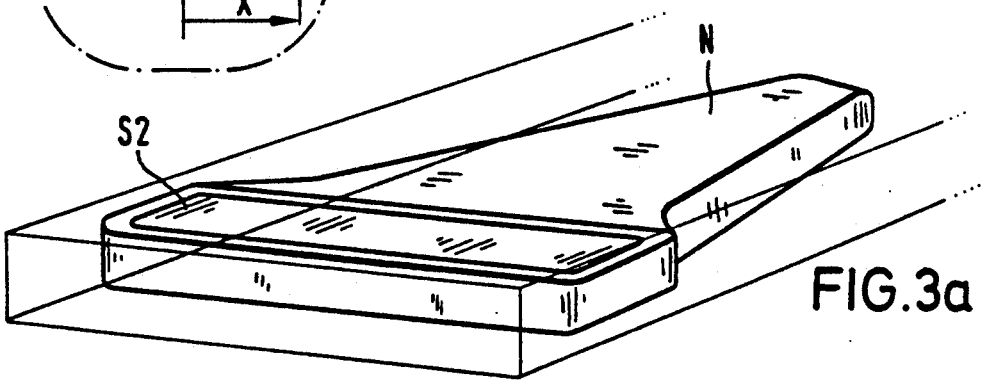
FIG. 3*a* depicts a projectile composed of a secondary coil S2 and a payload component N.
Figure 3B:
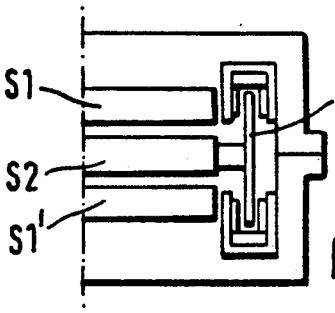
FIG. 3*b* depicts a projectile having attached guides with guide faces L disposed between guide rails.
Figure 3C:
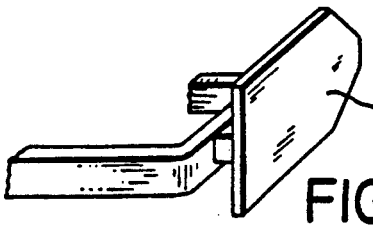
FIG. 3*c* shows more detail of the guide attached to the projectile of FIG. 3*b;*

In the flat coil arrangement according to the embodiment of FIG. 1, translator coil S2 is surrounded by two layers of primary coil arrangement S1 and S1'. Since translator coil S2 will serve as a driving component for a payload to be accelerated, e.g., a flying instrument or a projectile, configuration relationships between coil S2 and the instrument to be driven must also be considered. FIG. 3*a* shows an embodiment wherein a projectile that is flat as a whole is connected with coil S2. The cross section of the flying body is here adapted to the geometry of the channel determined by the stator arrangement. FIGS. 3*b* and 3*c* point out that lateral guide faces may be attached in order to stabilize the flight of the projectile, with a corresponding guide being provided for them within the channel. Coil S2 generates pressure forces for the payload of the projectile during the acceleration; these forces are exerted by the sides of the coil that extend transversely to the movement. Outwardly acting force components are exerted on the longitudinal sections of the coil sides. The coil must be appropriately supported against deforming force components.

Figure 4A:
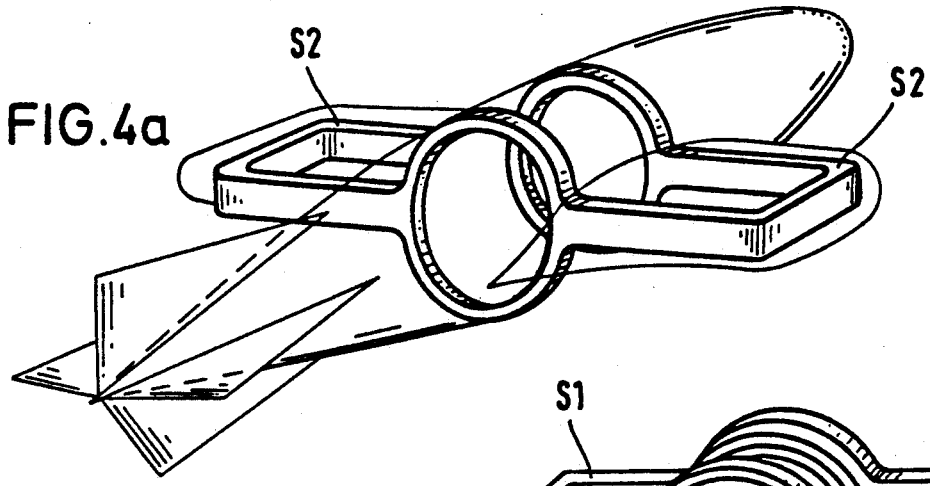
FIG. 4*a* depicts secondary coils attached to a flying body and their conductive connection.
Figure 4B:
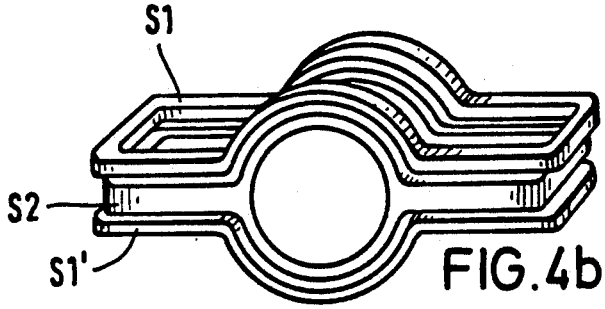
FIG. 4*b* shows the shape of the primary and secondary coils in an arrangement for catapulting the flying body of FIG. 4*a;*

In using coil forces to accelerate flying instruments or projectiles, it must be insured that the force is distributed over a sufficiently large cross section and with manageable mechanical stresses. FIG. 4*a* shows an embodiment in which the secondary coil arrangement is connected on two sides to the fuselage of a flying instrument. This creates relatively favorable conditions for the introduction of force from the secondary coil into the fuselage of the flying body. The transfer of forces can thus be effected with manageable voltages. FIG. 4*b* shows the two layers of the primary coils S1 and S1' which are connected across and above the fuselage of the flying body. In the outer regions (outside of the fuselage) the coil arrangement is configured to correspond to the basic flat coil model of FIG. 1. In the region of the fuselage, the arrangement is divided to the extent that the secondary coil S2 is guided on a circular arc. In each half side, this results in a unilateral interaction which, however, due to the symmetry, comes substantially close to the optimum conditions in the intensity of its interaction.

An increase in the driving force, in order to realize the highest possible accelerations with limited stress on the coils, leads to an increase in the coil surfaces that are arranged externally on the flying body. In order to reduce overhangs and simultaneously enlarge force introducing cross-sections, the arrangement of a plurality of secondary coils one behind the other (in the direction of flight) is a suitable solution. The coefficient of air resistance of the flying body is only slightly adversely effected by this configuration.

Figure 5A:
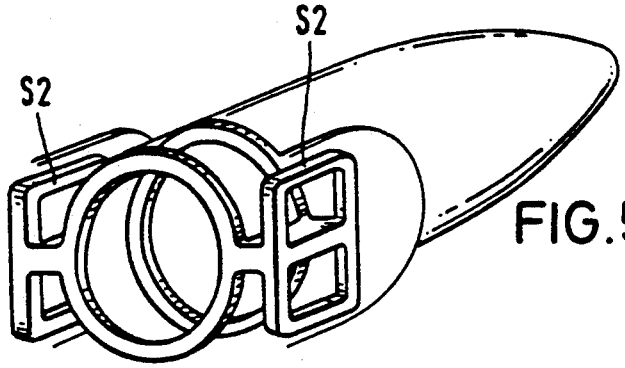
FIG. 5*a* shows secondary coils attached to a flying body having vertical and bent shape portions.
Figure 5B:
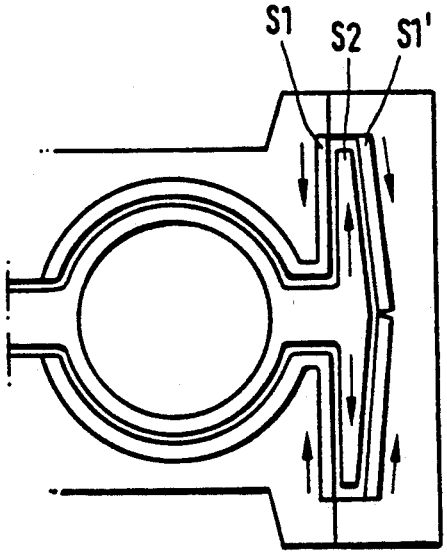
FIGS. 5*b* and 5*c* show the shape of primary and secondary coils in the arrangement according to FIG. 5*a;*
Figure 5C:
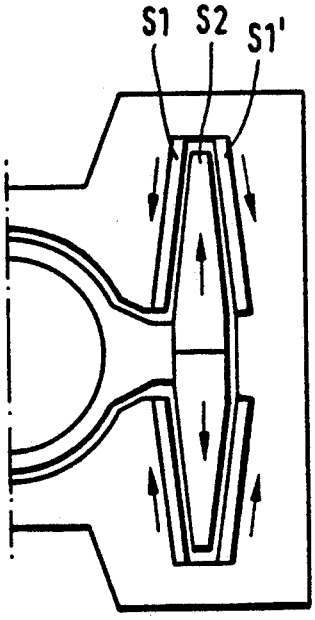

FIG. 5*a* shows a solution in which only short lever arms are provided for the introduction of the coil forces into the fuselage. The arrangement again corresponds to the basic concept of FIG. 1 which was also adhered to in connection with FIG. 4. Cross-sectional views of coils and stator structure are shown in FIGS. 5*b* and 5*c*. Here, the normal shape of the flat channel arrangement is noticeable in the outer region and as a circular arrangement with parallel flow in the interior region. The vertically attached outer coils allow, in addition to a favorable introduction of force (with a short lever arm) a compact configuration of the primary (stator) structure. FIG. 5*c* shows, in the form of a correspondingly cross-section friendly configuration of S2 and slightly conically arranged primary coils S1 and S1', the requirement for a sufficient cross-section for the transfer of forces into the fuselage being met in a particular manner.

Figure 6:
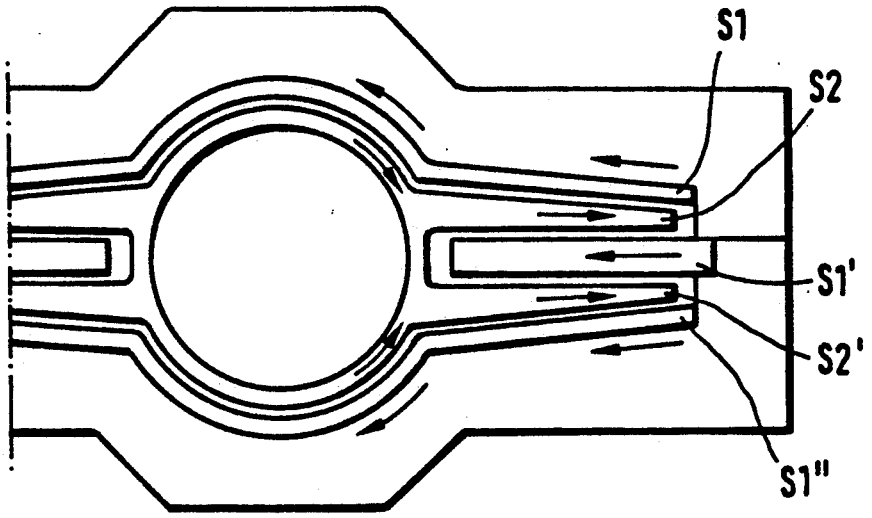
FIG. 6 depicts an arrangement having a primary coil divided into three layers and two-layer secondary coils.

A further variation of the configuration of the coil arrangement according to the invention for increasing force is shown in FIG. 6. Here, in contrast to FIGS. 5*b* and 5*c*, the stator primary coils are divided into three layers, namely S1, S1' and S1''. The direction of current flow is the same in all three layers. The translator secondary coil is divided into S2 and S2' and is disposed between the three coil layers of the stator. The five layers cooperate and result in an improved, i.e., greater, force generation intensity. In the central region, the concept of a simple layer division with parallel flow is retained. An advantage of the division of the coils, in addition to improved interaction and inductive coupling, is that there also result lower forces on each side of the coils.

The improvement measures for the field-current interaction must also consider in each case the feasibility of construction of the coil arrangement while maintaining sufficient strength and cross-sectional area for the introduction of force from the coil to the structure (of flying body and stator).

Figure 7:
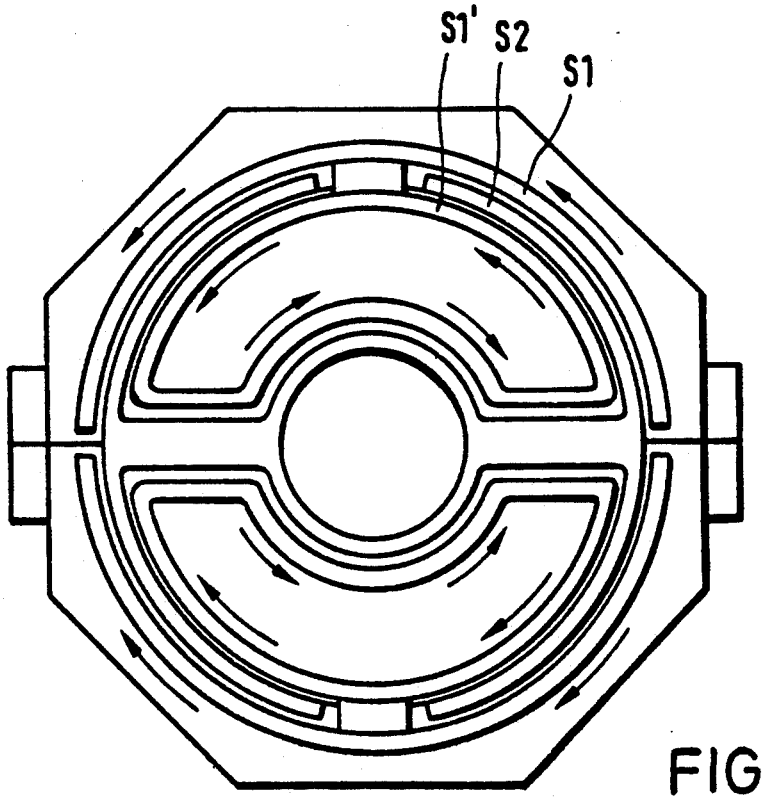
FIG. 7 depicts a cylindrically curved coil arrangement having a large active surface.

FIG. 7 is a cross-sectional view of an arrangement of stator and translator coils with a large interactive cross-sectional area and a limited exterior diameter. The stator arrangement includes a first portion having two kidney-shaped interior components with coils S1' surrounding them, and a second portion S1, surrounding a corresponding translator structure whose exterior coils S2 have a cylindrical shape. In the outer region, the three-layer arrangement of coils S1, S2 and S1' can be seen, while in the interior region there is a double two-layer arrangement of S1 and S2 similarly to the preceding configurations.

Characteristic of the described coil arrangements is an effectively configured secondary coil configuration outside of the payload region of the device to be moved, with a short lever arm and a suitable force introducing cross-section. Additionally, there is an electrical connection between the attached coils beyond the payload region which is also utilized for the generation of force. The primary and secondary coils are matched closely to one another in shape in order to realize small effective distances therebetween. For the acceleration of a larger instrument, it is advisable to make a mechanical connection between the coils and the flying instrument at several locations, with the basic features of the examples mentioned here being retained.

It should also be mentioned that it is possible for the secondary coil arrangement of the translator, which is necessary for acceleration, to be separated from the payload component subsequent to the acceleration process. Flight behavior is thus favorably influenced by the elimination, i.e., drop-off, of the translator drive unit. It may be possible to re-use the translator drive unit after a specified braking process, for example, if used for flying instruments.

Figure 8:
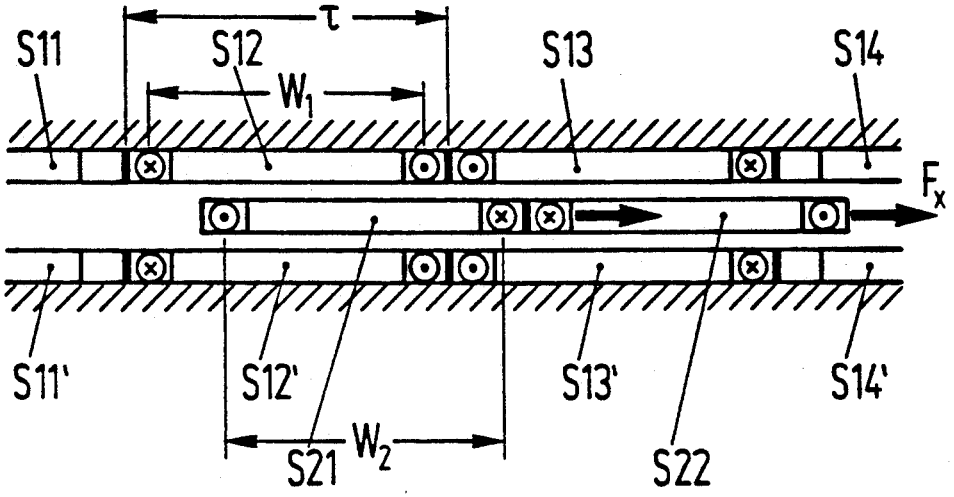
FIG. 8 depicts a coil arrangement with several primary coils and two secondary coils.

FIG. 8 represents a coil arrangement equipped with a plurality of coils in the primary portion, e.g., S11, S11', S12, S12', S13, S13', S14, S14', and two coils, S21 and S22, in the secondary portion. The coils of the primary portion are given the same geometrical dimensions on both sides of the channel. The primary coils of the upper side and the underside are connected in series. The pitch of the coils equals $\tau$ over the entire length of the channel. The width of the coils of the primary portion is substantially the same as that of the secondary portion.

As is shown in FIG. 8, two coil pairs of the primary portion, i.e., S12, S12', S13, S13', are in a force generating interaction with the two coil pairs, S21 and S22, of the secondary portion. It is also conceivable, in dependence on the energy supply circuit employed, that a plurality of coils of the primary portion carry current simultaneously. In the present case the field forces acting on the four conductors of the secondary system add up to a total force $F_x$.

For power matching, the coils arranged in the direction of movement (in the direction of force $F_x$) are constructed with different numbers of windings. The coils arranged at the right edge of the drawing figure, e.g., coils S14 and S14', have a lower number of windings than coils S11 and S11'.

Figure 9:
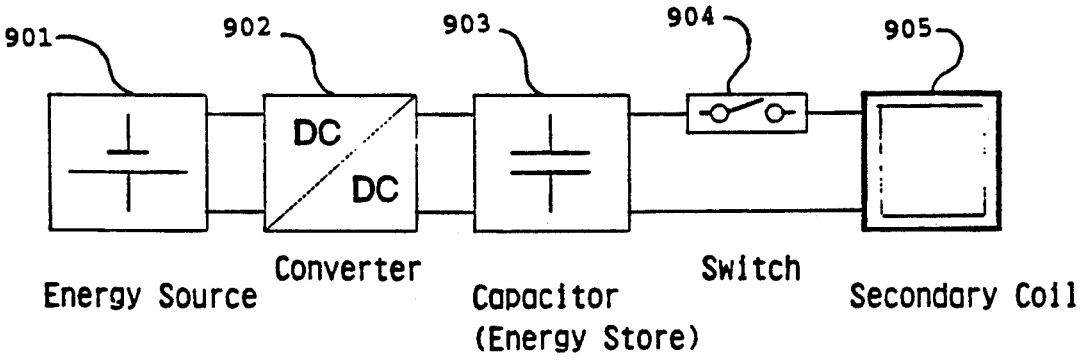
FIG. 9 depicts an energy supply circuit for the secondary coil.

FIG. 9 schematically represents an energy supply device for pre-excitation of the secondary coil. It is composed of a capacitively grounded energy source 901 (e.g. a battery, a monopolar generator) which charges a high power energy store 903 (capacitor) by way of a DC/DC converter 902. After closing of the switch 904, the capacitor 903 increases the magnetization of the secondary coil 905.

It will be apparent to one of ordinary skill in the art that the manner of making and using the claimed invention has been adequately disclosed in the above-written description of the preferred embodiment taken together with the drawings.

It will be understood that the above description of the preferred embodiment of the present invention is susceptible to various modifications, changes, and adaptations, and the same are intended to be comprehended within the meaning and range of equivalents of the appended claims.

What is claimed is:

1. An electromagnetic accelerator arrangement comprising:

a stationary arrangement including at least one stationary primary coil; and a movable arrangement including at least one moveable secondary coil, wherein the planes of the stationary and the moveable coils are parallel to a direction of movement of the moveable arrangement;

wherein the coils of the stationary and the movable arrangements have approximately the same coil width in the direction of movement of the moveable arrangement and transversely thereto; and wherein the at least one stationary primary coil comprises at least two layers between which the at least one secondary coil of the movable arrangement is movably disposed, the distance between the layers being kept small transversely to the direction of movement of the moveable arrangement.

2. An electromagnetic accelerator arrangement as defined in claim 1, wherein the moveable arrangement comprises a flying instrument and wherein the stationary coil layers comprise correspondingly shaped primary coils disposed external to the flying instrument electrically connected with one another such that a small distance is realized therebetween.

3. An electromagnetic accelerator arrangement as defined in claim 2, wherein surfaces of the primary coils are bent or curved.

4. An electromagnetic accelerator arrangement as defined in claim 2, wherein the at least one primary coil comprises more than two layers and the at least one secondary coil comprises more than one layer, and wherein a small distance is maintained between respective layers.

5. An electromagnetic accelerator arrangement as defined in claim 1, wherein the at least one movable secondary coil is pre-excited when the moveable arrangement is at a standstill.

6. An electromagnetic accelerator arrangement as defined in claim 1, wherein the at least one stationary primary coil is constructed as a multi-conductor coil arrangement.

7. An electromagnetic accelerator arrangement as defined in claim 1, wherein the stationary arrangement comprises a plurality of stationary primary coils disposed along the stationary arrangement in the direction of movement of the moveable arrangement, and wherein the number of windings per coil of the respective stationary primary coils decreases in the direction of movement along the stationary arrangement.

8. A flat coil electromagnetic accelerator arrangement for accelerating an object comprising:

guide means, having at least first and second sides, for guiding the object to be accelerated, the object traveling between the sides of the guide means;

at least one primary coil means, having first and second flat primary coils disposed opposite one another along first and second sides, respectively, of the guide means, for producing a magnetic field which extends between the first and second sides; and secondary coil means, having at least one flat secondary coil moveably disposed between the first and second sides of said guide means and in contact with the object to be accelerated, for interacting with the magnetic field of the at least one primary coil means to thereby produce an accelerating force on the object;

wherein planes of the flat primary and secondary coils are parallel to a direction of movement of the object along the guide means;

wherein the flat primary and secondary coils are of symmetrical design having substantially identical length and width dimensions; and wherein the spacing between respective first and second flat primary coils and the at least one flat secondary coil is small transversely to the direction of movement of the object to be accelerated.

9. An electromagnetic accelerator arrangement comprising:

a stationary arrangement including at least one stationary primary coil; and a movable arrangement including at least one moveable secondary coil having a plurality of windings, wherein the planes of the stationary and the moveable coils are parallel to a direction of movement of the moveable arrangement;

wherein the coils of the stationary and the movable arrangements have approximately the same coil width in the direction of movement of the moveable arrangement and transversely thereto;

wherein the at least one stationary primary coil comprises at least two layers between which the at least one secondary coil of the movable arrangement is movably disposed, the distance between the layers being kept small transversely to the direction of movement of the moveable arrangement; and wherein the stationary arrangement comprises a plurality of stationary primary coils disposed regularly along the stationary arrangement in the direction of movement of the moveable arrangement.

10. An electromagnetic accelerator arrangement as defined in claim 9, wherein the number of windings per coil of the respective stationary primary coils decreases in the direction of movement along the stationary arrangement.

11. An electromagnetic accelerator arrangement as defined in claim 10, wherein the moveable arrangement comprises a projectile and wherein the at least one moveable secondary coil comprises two facing partial coils arranged at the projectile and conductively connected with each other.

12. An electromagnetic accelerator arrangement as defined in claim 9, wherein the moveable arrangement comprises a flying instrument;

wherein the stationary coil layers comprise correspondingly shaped primary coils disposed external to the flying instrument electrically connected with one another such that a small distance is realized therebetween; and wherein surfaces of the primary coils are bent or curved.

* * * * *